US006733302B1

(12) United States Patent
Smalley, Jr. et al.

(10) Patent No.: US 6,733,302 B1
(45) Date of Patent: May 11, 2004

(54) POWER CONNECTOR

(75) Inventors: Jared J. Smalley, Jr., Harrisburg, PA (US); Iosif R. Korsunsky, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/318,501

(22) Filed: Dec. 12, 2002

(51) Int. Cl.[7] ..... H01R 12/00

(52) U.S. Cl. ..... 439/65; 439/79

(58) Field of Search ..... 439/65, 79, 709, 439/733.1, 701, 608

(56) References Cited

U.S. PATENT DOCUMENTS 5,340,320 A * 8/1994 Puerner ..... 439/79

* cited by examiner

*Primary Examiner*—Alexander Gilman
(74) *Attorney, Agent, or Firm*—Wei Te Chung

(57) ABSTRACT

A power connector assembly (100) includes a plug (1) and a receptacle (2). The plug has a housing (11), a plurality of plug contacts (12) received in the housing, and a cover (13,13') attached on a rear side of the housing. The cover includes an upper portion (131,131') and a rear portion (132,132') extending perpendicularly from the upper portion. Opposite lateral sides of the rear portion each define thereon a cutout (133,133') engaging with corresponding protrusion (111) formed on the housing and an embossment (134,134') received in corresponding notch (112) defined besides the protrusion to thereby secure the cover on the housing. The width of the cover is changeable in order to meet different voltage requirements.

5 Claims, 7 Drawing Sheets

POWER CONNECTOR

BACKGROUND OF THE INVENTION

1. Field of the Invention

The present invention generally relates to an electrical connector, and particularly to a power connector for providing power between a motherboard and a daughter board.

2. Description of Prior Arts

The ever increasing density of components used in electronic packaging, such as those used for computers and the like, wrought by the development of integrated circuits, has created the need for power connectors to carry the power required by densely spaced logic and memory components. U.S. Pat. No. 5,158,471 teaches a power connector for interconnecting power between printed circuit boards includes plug and receptacle contacts, which are arranged adjacent to signal connector halves mounted on the circuit boards. Insulating housings of the plug and receptacle contacts are provided with the housing surrounding the receptacle contact to preclude accidental shorting as between multiple contacts. However, the insulating housing of the plug contacts is configured in an L-shape and the plug contacts are mainly exposed to the air such that signal transmission in the neighboring signal connector halves will be unavoidably influenced when there is power supplied with high voltage in the power connector.

U.S. Pat. No. 6,224,430, issued to Fujitsu Limited on May 1, 2001, discloses a power supply terminal assembly for supplying electric power to a back wiring board. The power supply terminal assembly includes a protective cover detachably attached on a dielectric terminal block via a pair of cover-fixing screws. The cover spaces the power supply terminal assembly from other connectors to provide a greater voltage rating. While, when a different voltage requirement is desired to be met, it is obvious that the construction of the power supply terminal assembly should be redesigned. Therefore, the manufacturing cost is increased.

Hence, a power connector for overcoming the above-mentioned defects of current art is highly desired.

BRIEF SUMMARY OF THE INVENTION

Accordingly, an object of the present invention is to provide a power connector with selectable covers which have different sizes to meet different voltage requirements.

In order to achieve the above-mentioned object, a power connector assembly adapted for interconnecting two circuit boards includes a power plug and a power receptacle. The power plug has an insulating housing defining therethrough a plurality of channels, a plurality of plug contacts received in the channels, and a first and a second covers selectively attached on a rear side of the housing. Each cover comprises an upper portion and a rear portion extending perpendicularly from an edge of the upper portion. Opposite lateral sides of the rear portion each define thereon a cutout and an embossment adjacent to the cutout. The cutouts are configured to engage with protrusions formed on the rear side of the housing and the embossments are structured to be received in notches defined on the rear side besides the protrusions to thereby secure the cover on the housing. The widths of the two covers are different in order to meet different voltage rating requirements.

Other objects, advantages and novel features of the invention will become more apparent from the following detailed description of the present embodiment when taken in conjunction with the accompanying drawings.

DETAILED DESCRIPTION OF THE INVENTION

Figure 1:
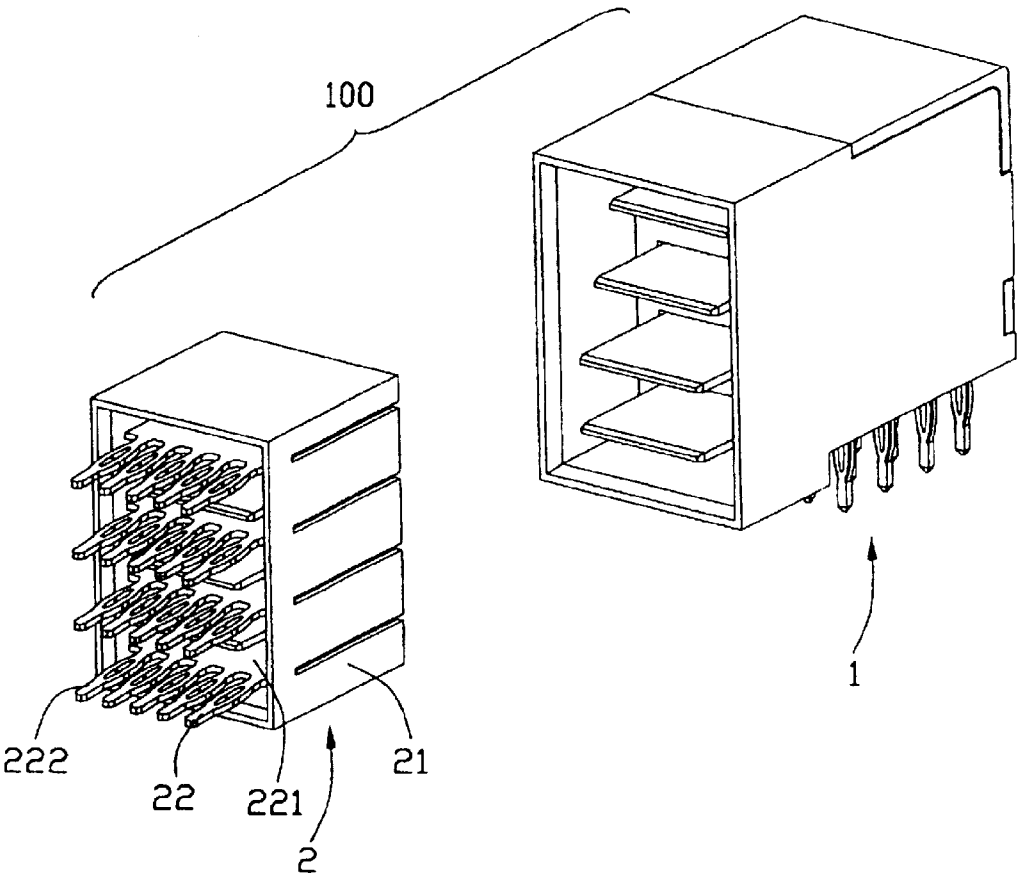
FIG. 1 is an exploded, perspective view of a power connector assembly including a power plug and a power receptacle.

Reference will now be made to the drawing figures to describe the present invention in detail.

Referring to FIG. 1, a power connector assembly 100 for coupling a mother board (not shown) having a power supply to a daughter board (not shown) having power consuming components is shown. The power connector assembly 100 includes a power plug 1 and a power receptacle 2 mating with the power plug 1.

As shown in FIGS. 2–5, the power plug 1 comprises an insulating housing 11, a plurality of plug contacts 12, and a first and a second covers 13, 13' which can be selectively attached to a rear side of the housing 11 during different voltage applications. The insulating housing 11 defines thereon a plurality of channels 14 for receiving corresponding plug contacts 12. Each plug contact 12 comprises a mating portion 121, a bended blade 122, and a plurality of connection pins 123 extending from an edge of the bended blade 122 along a perpendicular direction with respect to the corresponding mating portion 121. The mating portion 121 is configured to electrically connect with receptacle contacts 22 of the power receptacle 2, which will be described in detail hereinafter. The connection pins 123 are configured to be press-fitted in through-holes of a daughter board thereby providing power from a mother board, on which the power receptacle 2 is mounted, to the daughter board. The plug contacts 12 are parallelly arranged with the mating portions 121 being stacked along an up-to-down direction. The insulating housing 11 has a pair of protrusions 111 (see FIG. 5) oppositely formed on the rear side and a pair of notches 112 defined adjacent to the protrusions 111. A recess (not labeled) is defined in the rear side of the housing 11 between the pair of protrusions 11.

The first and the second covers 13, 13' have similar configurations while the widths are different from each other due to different voltage rating requirements. The first cover 13 of the power plug 1, includes an upper portion 131 and a rear portion 132 extending perpendicularly from an edge of the upper portion 131. Two lateral sides of the rear portion 132 each define thereon a cutout 133 for engaging with corresponding protrusions 111 of the housing 111 and an embossment 134 adjacent to corresponding cutout 133 for received in corresponding notches 112. A block 135 is formed on an inner side of the rear portion 132 for being received in corresponding recess to thereby secure the first cover 13 on the insulating housing 11. Particularly referring to FIGS. 4 and 5, it can be readily seen that the width of the cover 13 is equal to the width of the housing 11.

Figure 8:
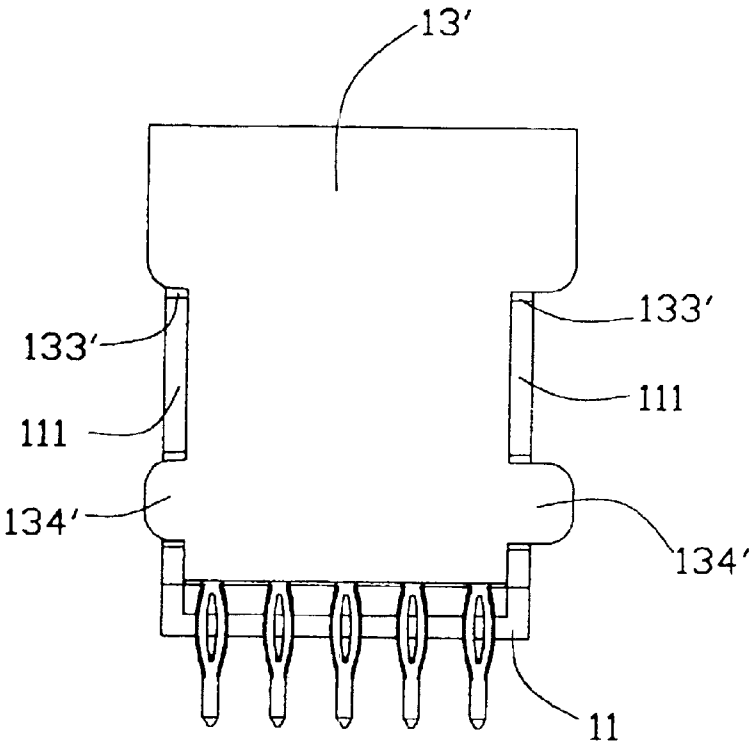
FIG. 8 is a back planar view of FIG. 7.
Figure 5:
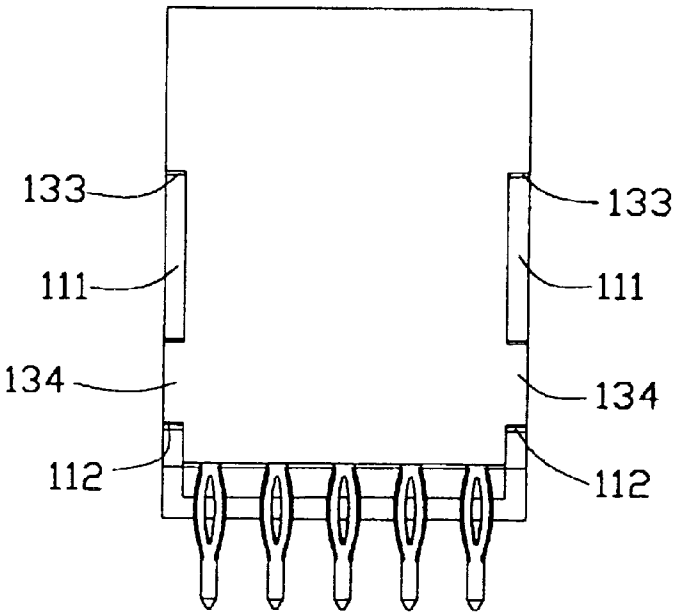
FIG. 5 is a back planar view of FIG. 4.
Figure 6:
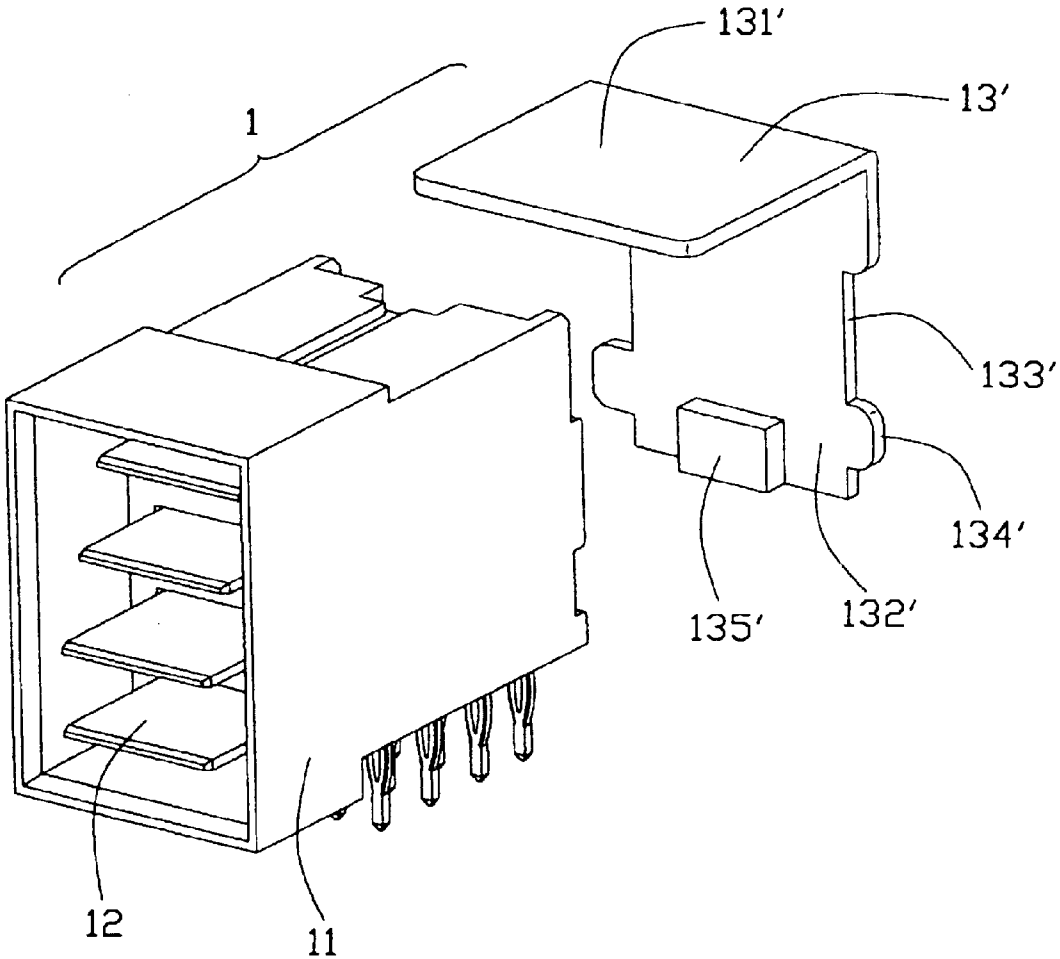
FIG. 6 is a partially exploded, perspective view of the power plug employing a second cover.
Figure 7:
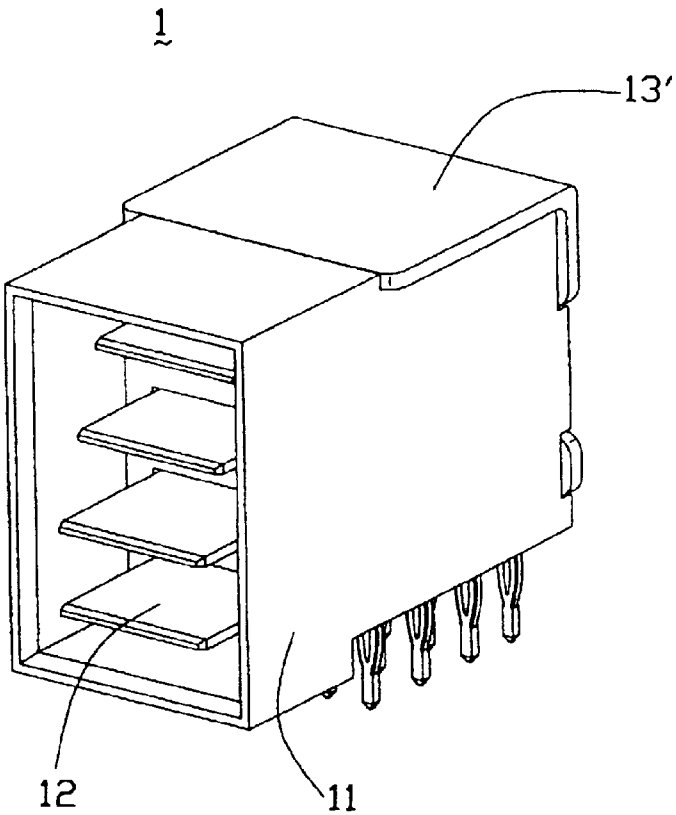
FIG. 7 is an assembled view of FIG. 6.

Turn to FIG. 6 in conjunction with FIGS. 7 and 8, the power plug 1 employing the second cover 13' is shown. Similarly, the second cover 13' includes an upper portion 131' and a rear portion 132' extending perpendicularly from an edge of the upper portion 131'. Two lateral sides of the rear portion 132' each define thereon a cutout 133' for engaging with corresponding protrusions 111 of the housing 11 and an embossment 134' adjacent to corresponding cutout 133'. It can be easily seen that the two embossments 134' of the second cover 13' extend beyond the two opposite sides of the housing 11 different lengths. A block 135' is formed on an inner side of the rear portion 132' for being received in corresponding recess to thereby secure the second cover 13' on the insulating housing 11. Compared with the first cover 13, the second cover 13' has a larger size than the first cover 13 as well as the insulating housing 11, so that the larger, second cover 13' can provide a greater voltage rating than the narrower, first cover 13 can provide.

It is well known that there are two factors that affect voltage, the spacing inside the connector and the distance between the two neighboring connectors. Clearly, when the housing remains unchanged, the narrower, first cover 13 disclosed in present invention can provide a predetermined voltage rating, while the wider, second cover 13' can provide a greater voltage rating than the narrow one. In an alternative embodiment, a third cover having a third size may be in use to meet a predetermined voltage rating requirement. In other words, the covers having different sizes can be selected to be assembled to the housing in order to meet different applications when a particular voltage rating is required. All of the covers can be made in the same mold so that the manufacturing cost is notably decreased. On the other hand, the covers with different sizes facilitate the connectors being positioned in the appropriate places where different voltage ratings are correspondingly required.

Figure 2:
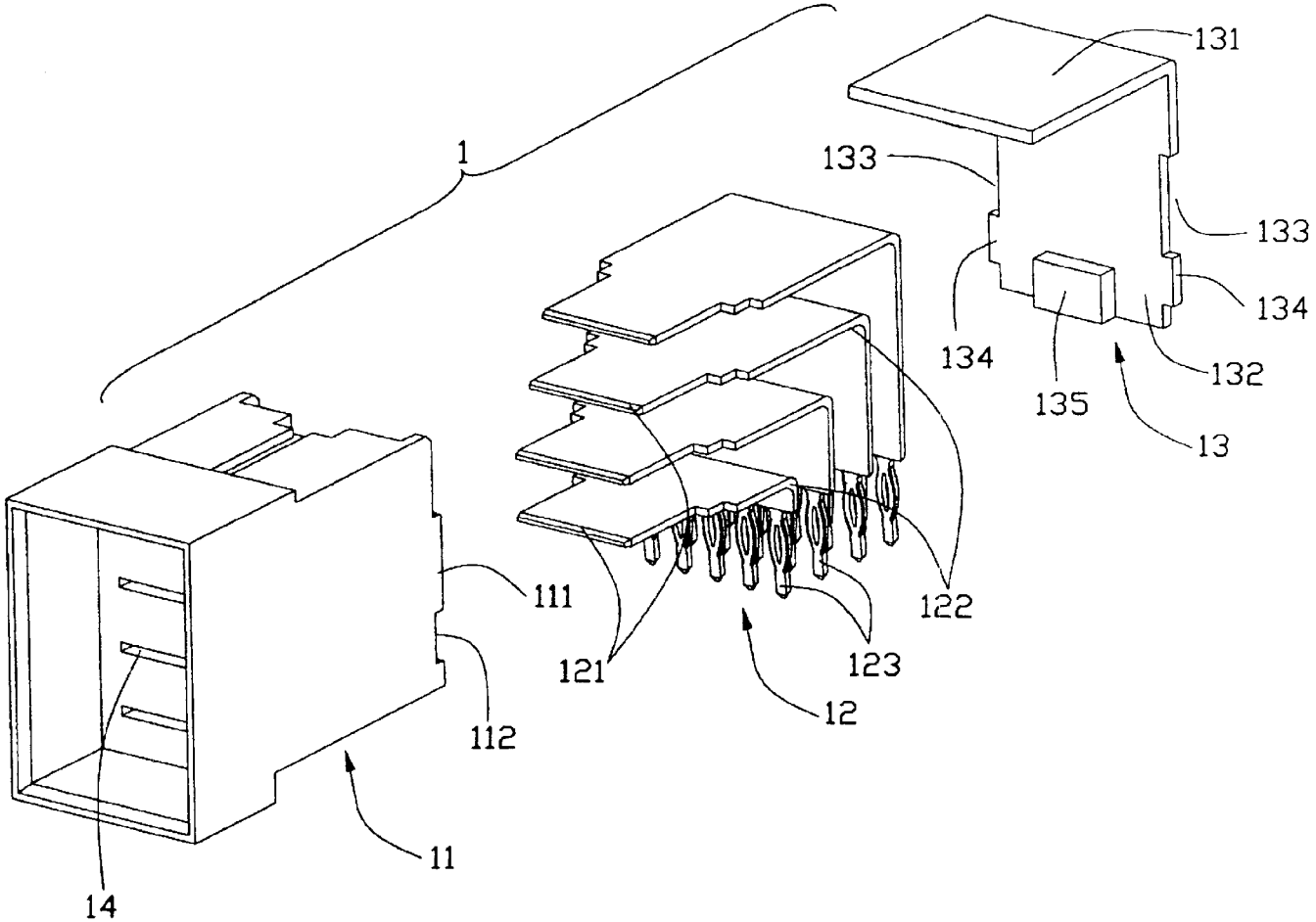
FIG. 2 is an exploded perspective view of a power plug employing a first cover.
Figure 3:
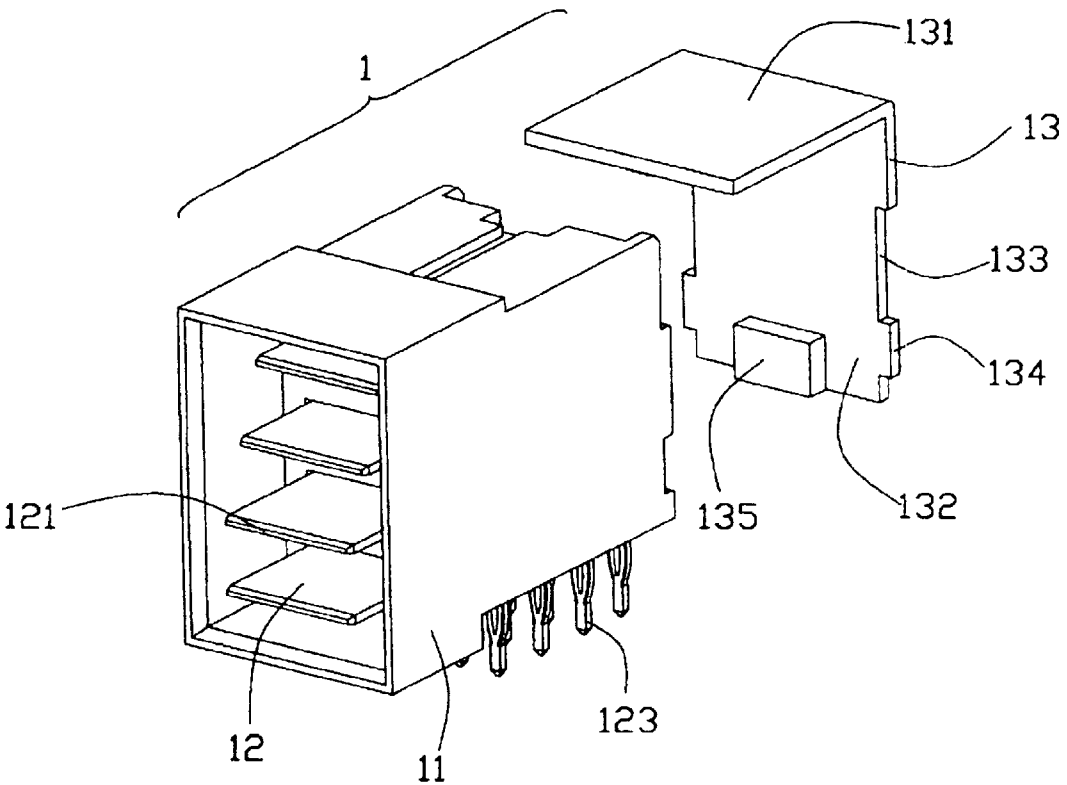
FIG. 3 is a partially assembled view of FIG. 2.
Figure 4:
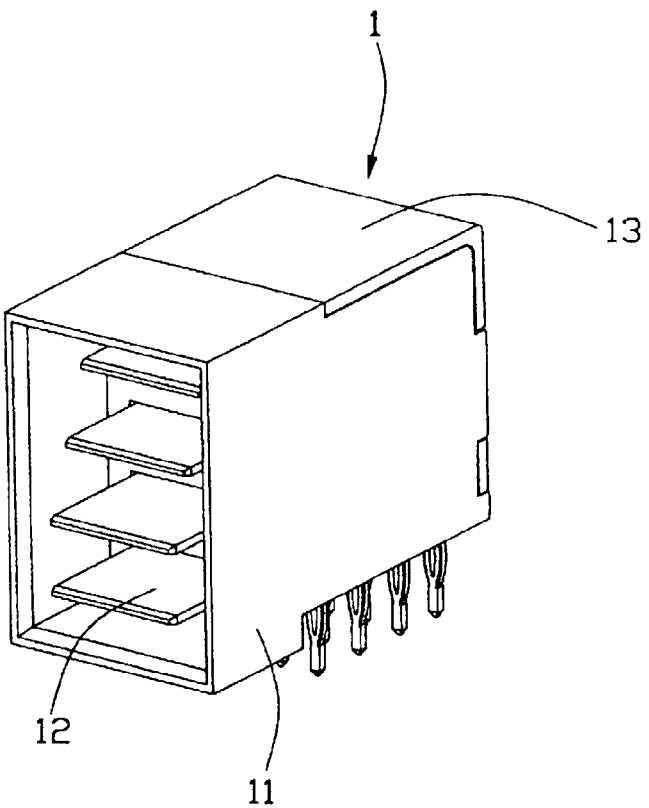
FIG. 4 is an assembled view of FIG. 2.

Continue to FIGS. 1 and 2, the power receptacle 2 comprises an insulating housing 21 and a plurality of receptacle contacts 22 received in the insulating housing 21. Each receptacle contact 22 comprises a base portion 221, a plurality of connection fingers (not shown) extending from a forward edge of the base portion 221 for electrically engaging with the mating portion 121 of the power plug 1, and a plurality of connections tails 222 extending from a rearward edge of the base portion 221 for electrically engaging with the mother board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A power connector for providing power between two circuits of circuit boards, comprising:

an insulating housing;

a number of parallel arranged, plug contacts received in said housing; and at least two covers selectively and detachably assembled to said housing, said at least two covers each comprising a first plate and a second plate extending perpendicularly to said first plate, said first and second plates covering a top and a rear of said housing, respectively;

wherein a particular one of said at least two covers assembled to said housing has a width size different from the other one to meet a different voltage rating requirement wherein each contact being substantially extended between lateral walls of the housing in a width direction.

2. The power connector as described in claim 1, wherein said at least two covers each have a block formed on an inner side of said second plate and said housing defines a recess on the rear thereof for mechanically receiving said block.

3. The power connector as described in claim 2, wherein said at least two covers each define a pair of cutouts and embossments on opposite lateral sides thereof, and said housing defines a pair of protrusions and notches on the rear thereof for mechanically engaging with corresponding cutouts and embossments to thereby secure said covers on said housing.

4. The power connector as described in claim 3, wherein each of said plug contact comprises a horizontally extended, mating portion, a bended blade connected with said mating portion, and a number of connections pins extending downwards from an edge of said bended blade for press-fitted in holes of the circuit board.

5. The power connector as described in claim 4, wherein the width of one of said at least two covers is equal to that of said housing.

* * * * *